US006253172B1

(12) United States Patent
Ding et al.

(10) Patent No.: US 6,253,172 B1
(45) Date of Patent: Jun. 26, 2001

(54) SPECTRAL TRANSFORMATION OF ACOUSTIC SIGNALS

(75) Inventors: Yinong Ding, Plano; Susan Yim, Richardson; Alan V. McCree, Dallas, all of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/153,980

(22) Filed: Sep. 16, 1998

Related U.S. Application Data

(60) Provisional application No. 60/062,430, filed on Oct. 16, 1997.

(51) Int. Cl.[7] ..... G10L 19/04
(52) U.S. Cl. ..... 704/219; 704/262
(58) Field of Search ..... 704/219, 262, 704/265, 268

(56) References Cited

U.S. PATENT DOCUMENTS 5,233,659 * 8/1993 Ahlberg ..... 704/230
5,642,465 * 6/1997 Scott et al. ..... 704/220
5,884,251 * 3/1999 Kim et al. ..... 704/219
5,903,866 * 5/1999 Shoham ..... 704/265
6,104,992 * 8/2000 Gao et al. ..... 704/220

* cited by examiner

*Primary Examiner*—Fan Tsang
*Assistant Examiner*—Michael N. Opsasnick
(74) *Attorney, Agent, or Firm*—Robert L. Troike; Frederick J. Telecky, Jr.

(57) ABSTRACT

An improved method of providing a pitch shifted or frequency transformed signal includes frequency scaling the original signal (12) and generating a desired spectrum envelope of the frequency transformed signal, $A_s(z)$ by LPC analysis of the original signal (11). Further the method includes producing an approximation of the spectrum envelope of the frequency scaled signal $A_s(z, \beta)$ by performing LPC analysis on the original signal (11), obtaining LSFs (13), scaling (15) and transforming the scaled LSFs back to LPC (17). The spectrum envelope of the frequency scaled signal is whitened or flattened by the approximation of the spectrum of the frequency scaled signal and the desired spectrum envelope is added at filter (19) where the transfer characteristics of the filter is $$\frac{A_s(z, \beta)}{A_s(z)}.$$

11 Claims, 2 Drawing Sheets

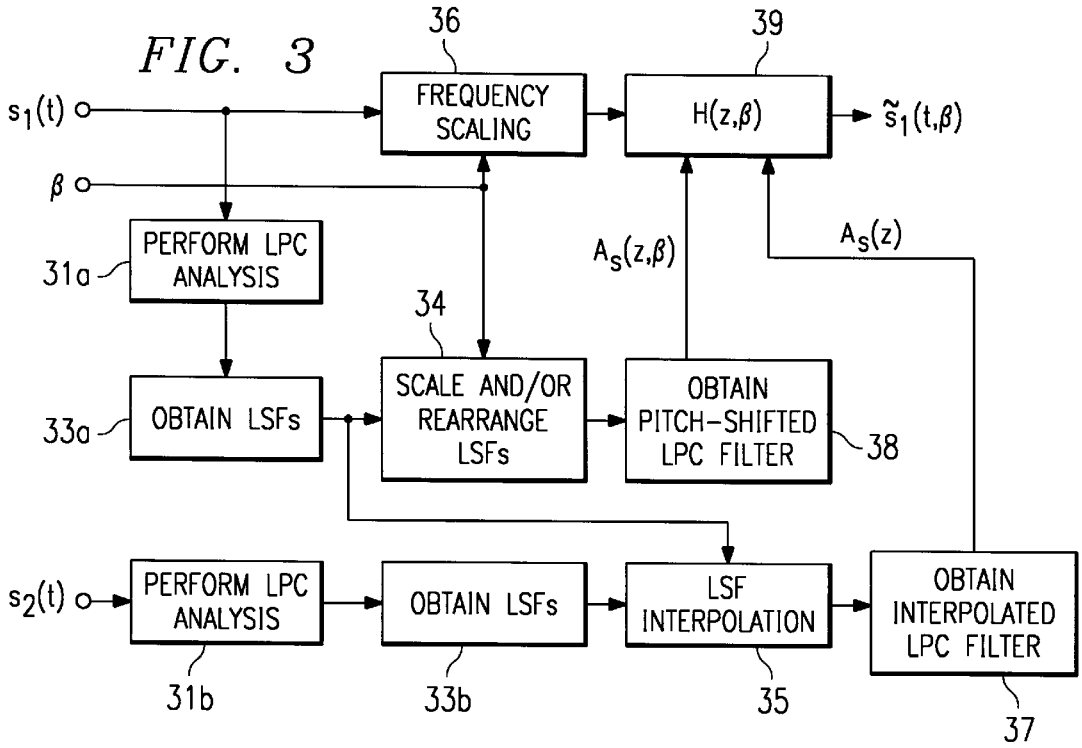
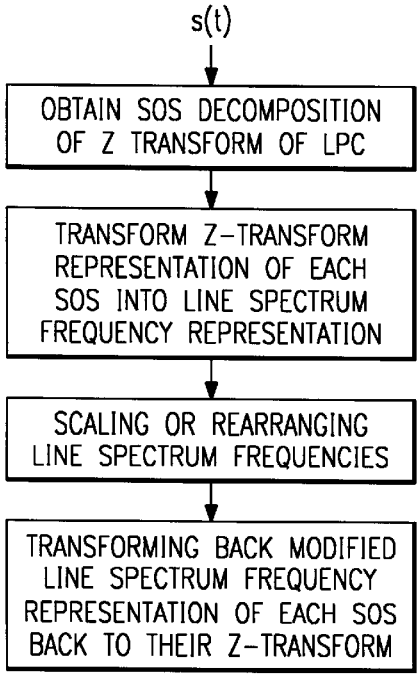
FIG. 5
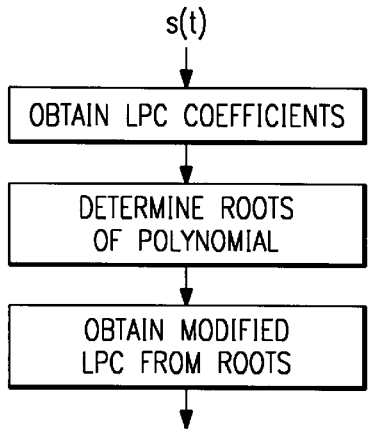
FIG. 6

SPECTRAL TRANSFORMATION OF ACOUSTIC SIGNALS

This application claims priority under 35 USC §119(e) (1) of provisional application number 60/062,430, filed Oct. 16, 1997.

TECHNICAL FIELD OF THE INVENTION

This invention relates to spectral transformation of acoustic signals.

BACKGROUND OF THE INVENTION

In a number of important applications it is desirable to carry out spectral transformations on acoustical signals. In speech signal processing, the speech may be compressed or expanded in frequency. In particular, frequency compression is useful in bandwidth reduction or in placing the speech into a desired frequency range as an aid to the hearing impaired. Another speech application requires that the fundamental frequency of the speaker be modified while preserving the shape of the envelope of the short-time speech spectrum. This operation is useful in psychoacoustic research and in correcting pitch discontinuities in concatenated speech segments. In musical signal processing, in order to synthesize all individual notes across the entire range of a particular musical instrument, a common practice is to analyze some of the original notes and store their parameters. At the synthesis stage, all other notes are obtained from the analyzed notes by pitch shifting. Generally speaking, in a sampler or a wavetable synthesizer, one original sound waveform is stored for every three or four notes. The pitch shifting is accomplished by sample rate conversion. It is well known that the pitch shifting through sample rate conversion preserves the original signal waveform, but creates two undesired effects. One is that it "compresses" the signal spectrum so that the pitch-shifted signal sounds "darker". To avoid aliasing, the pitch is always shifted down in samplers or wavetable synthesizers. The other one is that since the signal waveform shape is not changed among adjacent notes, musical sounds synthesized by a sampler or a wavetable synthesizer lack variations from note to note, and thus lack the realism of musical instruments. To improve the brightness and the realism of pitch-shifted signals, researchers are trying to use the result from speech signal analysis and synthesis, that is, trying to preserve the signal spectrum envelope when the original signal is pitch-shifted. Even though the physical reason of such use remains to be justified, it is widely accepted that the brightness of pitch-shifted signals does get improved by preserving the shape of the signal spectrum envelope.

A prior art frequency-domain approach is described by Quatieri, et al. in an article entitled, "Speech Transformations based on a Sinusoidal Representation," IEEE Transactions on Acoustics, Speech, and Signal Processing, Vol. 34, pp. 1449–1464, December 1989. Assume s(t) is the signal to be pitch-shifted by a factor β. According to Quatieri, et al., the pitch shifting or frequency transformation is performed as follows. First, a transfer function $$H(\omega, t)=M(\omega, t)\exp[j\Phi(\omega, t)]$$

is obtained. (In practice, only uniform samples of $H(\omega, t)$ from the Discrete Fourier Transform (DFT) are available and stored. The magnitude response of this transfer function, $H(\omega, t)$, is a good approximation to the spectrum envelope of the signal s(t). The phase function, $\Phi(\omega, t)$, is the Hilbert transform of $M(\omega, t)$. So the transfer function $H(\omega, t)$ represents a minimum phase system. The socalled excitation signal e(t) can then be obtained by filtering s(t) through the inverse system of $H(\omega, t)$. The excitation signal e(t) can be expressed using a sinusoidal model as $$e(t)=\sum_{l}^{L} a_l(t)\cos\left[\int_0^t \omega_l(\sigma)d\sigma+\eta_l\right]$$

When a pitch modification is needed, each sine-wave component of the excitation signal is scaled by a desired factor β to generate a new frequency track at $\beta\omega_l(t)$. The excitation amplitude $a_l(t)$ is then shifted to the new frequency track location. To preserve the shape of the spectrum envelope, the amplitudes and phases of $H(\omega, t)$ must be computed at the new frequency track location $\beta\omega_l(t)$. They are obtained by sampling (interpolation in frequency) $M(\omega, t)$ and $\Phi(\omega, t)$, respectively.

With the above modified excitation and system magnitudes and phases, the resulting modified signal waveform, denoted as $\tilde{s}(t, \beta)$, is given by $$\tilde{s}(t, \beta)=\sum_{l}^{L} a_l(t)M(\beta\omega_l, t)\cos\left\{\int_0^t \beta\omega_l(\sigma)d\sigma+\eta_l+\Phi(\beta\omega_l, t)\right\}.$$

It is not difficult to see that this frequency domain approach requires a large amount of memory (to store the samples of $M(\omega, t)$ and $\Phi(\omega, t)$, and computations (to obtain the system magnitudes and phases at new frequency track location.)

SUMMARY OF THE INVENTION

In accordance with one embodiment of the present invention, an improved method of pitch modification or frequency transformation includes the steps of getting the desired spectrum envelope, an approximation of the spectrum envelope of frequency scaled signal whitening or flattening of the spectrum envelope of the frequency scaled signal and applying back the desired spectrum envelope to the whitened frequency scaled signal.

These and other features of the invention will be apparent to those skilled in the art from the following detailed description of the invention, taken together with the accompanying drawings.

DESCRIPTION OF THE DRAWINGS

In the drawing:

FIG. 3 is a block diagram of frequency transformation according to a third embodiment of the present invention;

FIG. 5 illustrates a method of providing an approximation of the spectrum envelope of the frequency scaled signal; and FIG. 6 illustrates another method of providing an approximation of the spectrum envelope of the frequency scaled signal.

DESCRIPTION OF PREFERRED EMBODIMENTS

Figure 1:
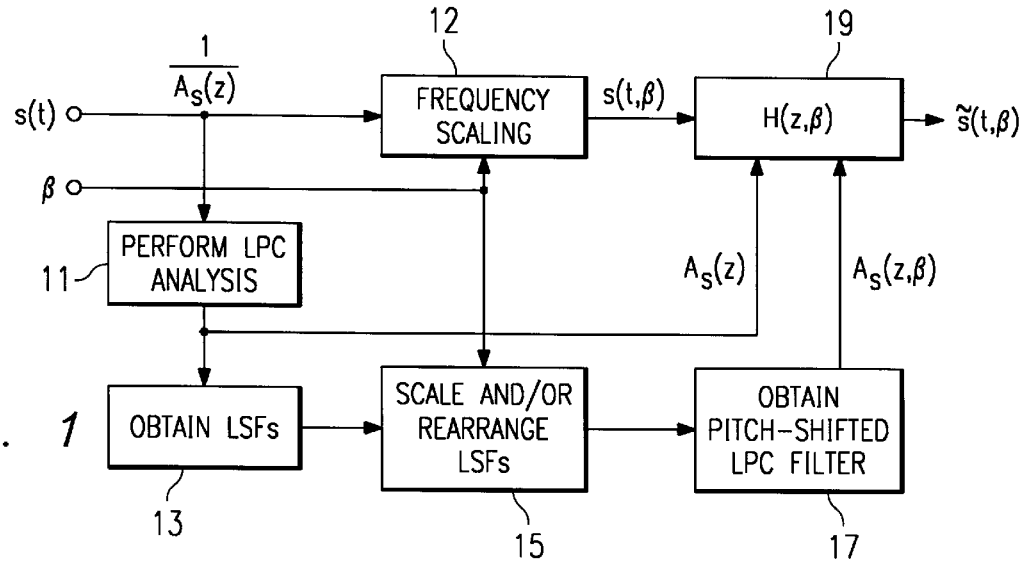
FIG. 1 is a block diagram of frequency transformation for some applications such as voice according to one embodiment of the present invention.

Applicants teach to use the following spectrum transformation method by time-domain filtering as shown in FIG. 1. This method of FIG. 1 is particularly suitable for voice where the spectrum envelope is to be preserved when the fundamental frequency of the voice is modified. Assume s(t) is the original signal to be pitch-shifted or frequency transformed by a factor β. An LPC (Linear Prediction Coding) analysis on the original signal s(t) is performed at stage 11 to obtain its spectral envelope or LPC filter transfer function $A_s(z)$. The magnitude spectrum of $A_s(z)$ is approximately the reciprocal of the spectrum envelope of s(t). The "difference filter" and "sum filter" associated with the line-spectrum pair (LSP) representation of $A_s(z)$ can then be obtained, $$P(z)=A_s(z)-z^{-(n+1)}A_s(z^{-1}), \text{ (difference filter)}$$

$$Q(z)=A_s(z)+z^{-(n+1)}A_s(z^{-1}), \text{ (sum filter )}$$

where n is the order of $A_s(z)$. The angle frequencies of the roots of P(z) and Q(z) are as denoted, respectively, by $\omega_{P_i}$ and $\omega_{Q_i}$, i=1, . . . , n+1.

The next stage 12 is to get the frequency scaled version (by the factor β) of s(t), which is denoted by s(t, β). There are numerous ways to obtain a frequency scaled version of signal s(t), including sample rate conversion and other parametric modeling based approaches. For example, see Yinong Ding and Xiaoshu Qian, "Processing of Musical Tones Using a Combined Quadratic Polynomial Phase Sinusoids and Residual (QUASAR) Signal Model," Journal of the Audio Engineering Society, Vol. 45, No. 7/8, pp. 571–584, July/August 1997. In the meantime, we obtain the Line Spectrum Frequencies (LSF) at stage 13 from the LPC coefficient and scale them with β and/or re-arrange them (stage 15) to obtain $\omega_{P_i}$ and $\omega_{Q_i}$, i=1, . . . , n+1. These line spectrum pairs correspond to a frequency-scaled version of $A_s(z)$, which we denote as $A_s(z, \beta)$. The LSFs are converted back to LPC coefficients at stage 17 to obtain an approximated version of $A_s(z, \beta)$.

Finally, we pass the frequency scaled signal s(t, β) at stage 12 through the following spectral transformation filter 19, $$H(z, \beta) = \frac{A_s(z, \beta)}{A_s(z)}.$$

We call H(z, β) the spectral transformation filter 19.

By the above procedure, the frequency transformed signal is performed by the following steps generating a desired spectrum envelope of the signal by the LPC analysis of the original (stage 11), an approximation of the spectrum envelope of the frequency scaled signal is obtained by scaling or rearranging of the LSF (stage 15), and at filter 19, the spectral envelope of the frequency scaled signal is whitened or flattened by the approximation of the spectrum envelope and the desired spectrum envelope is added.

In the presence of filter coefficient quantization, in order to reduce the sensitivity of the roots of a polynomial to the accuracy of its coefficients, for IIR filters implemented with fixed-point arithmetic, the direct form is generally avoided, and the cascade and parallel form preferred because they are comprised of less sensitive first and second order sections. Furthermore, the favor is given to the cascaded form because it is more robust under coefficient quantization than the parallel form. See text *Digital Filters and Signal Processing*, by L. B. Jackson, Published by Kluwer Academic Publishers, 1989. It is now given below that a procedure to obtain cascaded second order sections of a spectral transformation filter from its line spectral frequencies (LSFs). See FIG. 5

Assume n is an even number, consider an n-th order spectral transformation filter, H(z, β).

Step 1. Obtain a second-order-section (SOS) decomposition of A(z) as follows:

$$A_s(z) = A_{s,1}(z)\cdot A_{s,2}(z)\ldots A_{s,\frac{n}{2}}(z).$$

Each $A_{s,i}(z)$ is of second order.

Step 2. For each $A_{s,i}(z)$, i=1,2, . . . , n/2, find its LSFs, $f_i^p$ and $f_i^q$. Then, the corresponding difference and sum filters are given by $$P_i(z)=(1-z^{-1})[1-2\cos(2\pi f_i^p/f_s)z^{-1}+z^2],$$

$$Q_i(z)=(1+z^{-1})[1-2\cos(2\pi f_i^q/f_s)z^{-1}+z^2],$$

where $f_s$ is the sampling frequency.

Step 3. Scaling and/or rearranging the LSFs as needed to get $f_i^p$ and $f_i^q$.

Step 4. Finally, we obtain each "frequency scaled" second-order-section and form the required spectral transformation filter as follows:

$$A_{s,i}(z,\beta)=1-(\tilde{p}_i+\tilde{q}_i)z^{-1}+(1+\tilde{p}_i-\tilde{q}_i)z^{-2},$$

where $$\tilde{p}_i=\cos(2\pi f_i^p/f_s),$$

$$\tilde{q}_i=\cos(2\pi f_i^q/f_s),$$

$$H(z, \beta) = \prod_{i=1}^{\frac{n}{2}} \frac{A_{s,i}(z, \beta)}{A_{s,i}(z)}.$$

In the discussion herein the term stage is used. For the method case this is a step. For a system case, these stages are elements of the system wherein stage 11 is an analyzer, stage 12 is a scaler, stage 13 is a translator from LPC to LSFs, stage 17 is a translator from LSFs to LPC and stage 19 is a filter.

Figure 2:
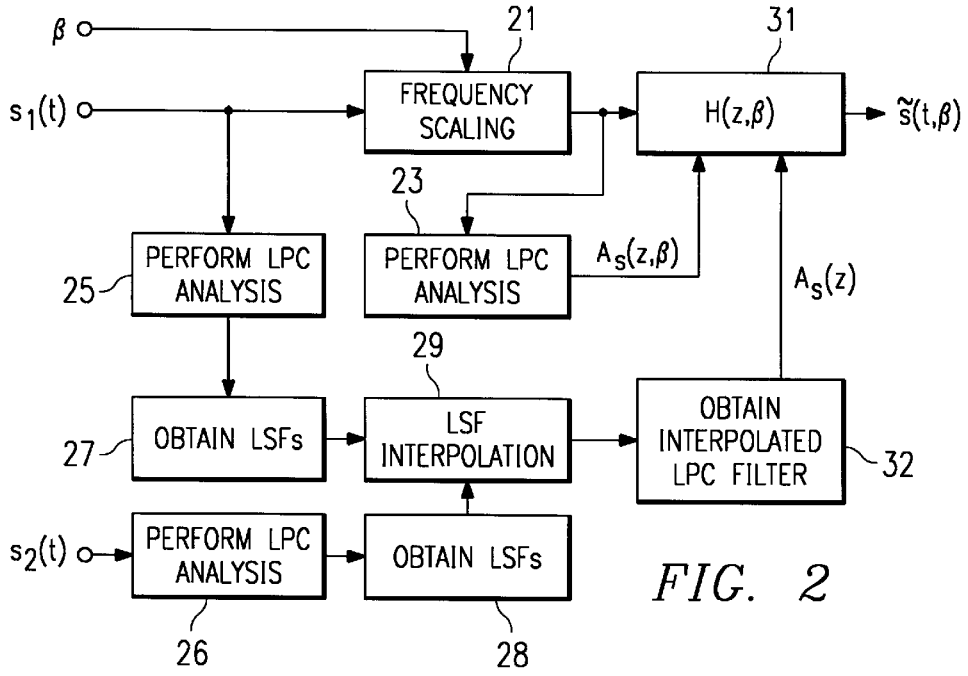
FIG. 2 is a block diagram of frequency transformations for some applications such as music synthesis according to another embodiment of the present invention.

In accordance with another embodiment of the present invention for some applications, e.g. music synthesis, a signal is to be shifted a given number of semitones. Normally, the range of pitch shifting can be determined ahead of time. In this case, an LPC analysis (stage 23) can be performed on signals s(t) that are frequency-scaled (stage 21) according to the pitch shifting range, and the resulting set of LPC filter coefficients $A_s(z, \beta)$ can be stored in memory for use in real time synthesis. In addition, we also teach that when several signals are to be obtained by pitch-shifting up the signal $s_1(t)$ and/or pitch-shifting down the signal $s_2(t)$, to ensure the timbre smoothness from $s_1(t)$ to $s_2(t)$, some type of timbre interpolation must be performed. This can be accomplished by interpolating two sets of LSFs obtained from $s_1(t)$ and $s_2(t)$, respectively. These considerations are taken into account in the diagram shown in FIG. 2. An LPC analysis of signal $s_1(t)$ is done at stage 25 and $s_2(t)$ at stage 26 to get the LPC filter transfer function $A_s(z)$ for two separated relevant known signals $s_1(t)$ and $s_2(t)$. The LPC coefficients are transformed to the LSFs at stages 27 and 28. At stage 29 interpolation of the two LSFs is performed to get the approximated LSFs for the desired signal. The approximated version of the spectrum envelope of the frequency scaled version is provided by the LPC analysis stage 23 coupled to the output of the frequency scaler 21. This output from stage 23 is used to flatten or whiten the spectrum envelope at filter 31. The interpolated LSFs output at stage 29 is transformed back to LPC at stage 32 and added back at filter 31.

In accordance to a third embodiment shown in FIG. 3, a signal $s_1(t)$ is to be pitch shifted or frequency transformed towards a signal $s_2(t)$. The two separated relevant known signals undergo LPC analysis at stages 31*a* and 31*b* and transformed to LSFs at stages 33*a* and 33*b*. An LSF interpolation between LSFs at 33*a* and 33*b* is performed to obtain the desired LSFs at stage 35 and from that the LSFs are transformed to LPC coefficients at stage 37 to provide the desired spectrum envelope. The signal $s_1(t)$ is frequency scaled at stage 36 by $\beta$. The LSFs at stage 33*a* is scaled or rearranged at stage 34 and the scaled 282 and/or rearranged LSFs at stage 34 are transformed to LPC at stage 38 to produce an approximation to the spectrum envelope of the frequency scaled signal to whiten or flatten the spectrum envelope of the frequency scaled signal at filter 39. The desired spectrum envelope from stage 37 is added back at stage 39.

Figure 4:
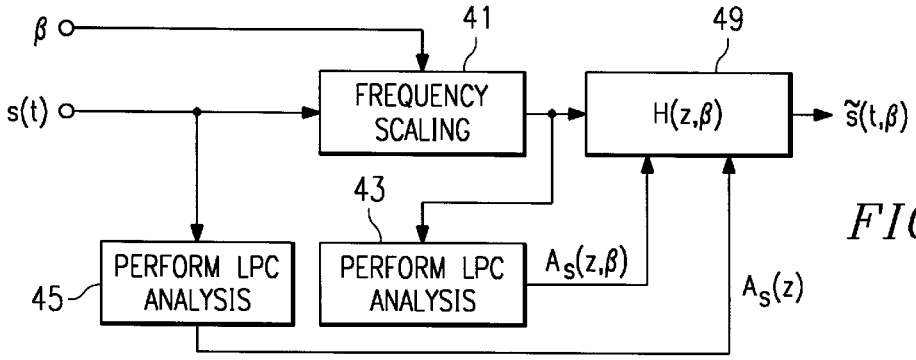
FIG. 4 is a block diagram of frequency transformation according to a fourth embodiment of the present invention.

In accordance with a fourth embodiment, as shown in FIG. 4, the signal s(t) is frequency scaled at stage 41 and the scaled output is applied to filter 49 and to stage 43 where an LPC analysis is done on the frequency scaled input signal to provide the approximation of the spectrum envelope of the frequency scaled input signal. An LPC analysis is done on the input signal s(t) at stage 45 to get the desired spectrum envelope to be added back after the whitening effect of the signal from stage 43.

Since the invention of the line spectrum pair concept, many researchers have tried to explore the relationship between the line spectrum frequencies and the LPC coefficients (the predictor roots). Due to the complexity of the problem, however, this relationship has never been clearly established. The lack of the direct relationship between the line spectrum frequencies (LSF) and the LPC coefficients increases the difficulty to obtain desired filter transfer functions by modifying the LSFs. On the other hand, the predictor roots have clearer physical meaning than the LSFs and their locations are good approximations to that of the "formants" in the case of speech processing. Therefore, it may be useful in some situations that one works with the predictor roots instead of the LSFs as shown in FIG. 1. This method of obtaining the approximating the spectrum envelope of the frequency scaled signal is provided by the steps of obtaining the LPC coefficients of the original signal, determining to roots of the LPC polynomial, scaling the angles of the polynomial roots, obtaining modified LPC coefficients from the scaled roots as shown in FIG. 6.

Applying the principles as stated above, we can do various mixing and matching to come out different ways to obtain desired spectral transformation filters.

Some major advantages for using the proposed approach for spectral transformation are listed below.

- Reduction in memory requirement for storing spectrum envelope information of the signal being modified/pitch shifted.
- Reduction in computations required for recovering the spectrum envelope of the pitch shifted signals.
- Reduction of parameters necessary for spectral transformation/modifications.
- Convenience for implementation of sound morphing/interpolation and other spectrum related sound modification operations.

Although the present invention and its advantages have been described in detail, it should be understood that various changes, substitutions and alterations can be made herein without departing from the spirit and scope of the invention as defined by the appended claims.

What is claimed is:

1. A method of obtaining a desired frequency transformed signal from an original signal, comprising the steps of:

generating a desired spectrum envelope of said frequency transformed signal by LPC analysis of said original signal;

frequency scaling said original signal to obtain a frequency scaled signal;

producing an approximation of the spectrum envelope of the frequency scaled signal by scaling and/or rearranging LSFs of said original signal;

whitening the spectrum envelope of said frequency scaled signal using the approximation of the spectrum envelope of the frequency scaled signal to provide a whitened frequency scaled signal; and adding said desired spectrum envelope of said frequency transformed signal to said whitened frequency scaled signal.

2. The method of claim 1 wherein said whitening includes time domain filtering.

3. The method of claim 1 wherein said approximation of the spectrum envelope is further provided by an LPC analysis to get LPC coefficients of said original signal and translation to LSFs and translations of LSFs back to LPC coefficients.

4. A method of obtaining a desired frequency transformed signal from an original signal, comprising the steps of:

generating a desired spectrum envelope of said frequency transformed signal by LSF interpolation of two separated relevant known signals;

frequency scaling said original signal to obtain a frequency scaled signal;

producing an approximation of the spectrum envelope of the frequency scaled signal;

whitening the spectrum envelope of said frequency scaled signal using the approximation of the spectrum envelope of the frequency scaled signal to provide a whitened frequency scaled signal; and adding said desired spectrum envelope of said frequency transformed signal to said whitened frequency scaled signal.

5. The method of claim 4 wherein said desired spectrum envelope is obtained by LPC analysis of said original signals and transforming said LPC coefficients to LSFs and said LSFs after interpolation back to LPC.

6. The method of claim 4 wherein said approximation of the spectrum envelope of the frequency scaled signal is provided by performing LPC analysis on said frequency scaled signal.

7. The method of claim 1 wherein said approximation of the spectrum envelope of the frequency scaled signal is provided by performing LPC analysis of said frequency scaled signal.

8. The method of claim 4 wherein said approximation of the spectrum envelope of the frequency scaled signal is provided by scaling or rearranging LSFs of the original signal.

9. The method of claim 8 wherein said approximation of the spectrum envelope includes performing LPC analysis of one of said original signals, transforming to LSFs and after scaling or rearranging transforming back to LPC coefficients.

10. The method of claim 1 wherein said approximation of the spectrum envelope of the frequency scaled signal is provided by the steps of:

obtaining second-order-section decomposition of the z-transform representation of the LPC coefficients of the original signal, transforming z-transform representation of each second-order-section into corresponding line spectrum frequency representation;

scaling and/or rearranging the line-spectrum frequencies as needed; and transforming back the modified line-spectrum frequency representation of each second-order-section back to their z-transform representation.

11. A method of obtaining a desired frequency transformed signal from an original signal, comprising the steps of:

generating a desired spectrum envelope of said frequency transformed signal;

frequency scaling said original signal to obtain a frequency scaled signal;

producing an approximation of the spectrum envelope of the frequency scaled signal wherein said approximation of the spectrum envelope is provided by the steps of: obtaining the LPC coefficients of the original signal, determining the roots of the LPC polynomial, scaling the angles of the polynomial roots, and obtaining modified LPC coefficients from the scaled roots;

whitening the spectrum envelope of said frequency scaled signal using the approximation of the spectrum envelope of the frequency scaled signal to provide a whitened frequency scaled signal; and adding said desired spectrum envelope of said frequency transformed signal to said whitened frequency scaled signal.

* * * * *